US011779976B2

(12) United States Patent
Weinzierl

(10) Patent No.: US 11,779,976 B2
(45) Date of Patent: Oct. 10, 2023

(54) APPLICATION DEVICES FOR COOLING SECTIONS, HAVING A SECOND CONNECTION

(71) Applicant: Primetals Technologies Germany GmbH, Erlangen (DE)

(72) Inventor: Klaus Weinzierl, Nuremberg (DE)

(73) Assignee: PRIMETALS TECHNOLOGIES GERMANY GMBH

( * ) Notice: Subject to any disclaimer, the term of this patent is extended or adjusted under 35 U.S.C. 154(b) by 323 days.

(21) Appl. No.: 17/274,212

(22) PCT Filed: Jul. 30, 2019

(86) PCT No.: PCT/EP2019/070427
§ 371 (c)(1),
(2) Date: Mar. 8, 2021

(87) PCT Pub. No.: WO2020/052854
PCT Pub. Date: Mar. 19, 2020

(65) Prior Publication Data

US 2021/0354182 A1 Nov. 18, 2021

(30) Foreign Application Priority Data

Sep. 12, 2018 (EP) ..... 18193920

(51) Int. Cl.
*B21B 37/76* (2006.01)
*B21B 45/02* (2006.01)

(52) U.S. Cl.
CPC ..... *B21B 37/76* (2013.01); *B21B 45/0218* (2013.01)

(58) Field of Classification Search
CPC ..... B21B 45/0203; B21B 45/0209; B21B 45/0215; B21B 45/0218; B21B 37/74; B21B 37/76
See application file for complete search history.

(56) References Cited

U.S. PATENT DOCUMENTS 10,722,929 B2 7/2020 Chen et al.
2010/0044024 A1* 2/2010 Beeston ..... B21B 45/0233 165/185

(Continued)

FOREIGN PATENT DOCUMENTS

CN 102497941 A 6/2012
CN 103764315 A 4/2014

(Continued)

OTHER PUBLICATIONS

Chinese Office Action, dated Jun. 30, 2022, issued in corresponding Chinese Patent Application No. 201980059890.4. English translation of Search Report. Total 9 pages.

(Continued)

*Primary Examiner* — Bobby Yeonjin Kim
(74) *Attorney, Agent, or Firm* — OSTROLENK FABER LLP

(57) ABSTRACT

A cooling section (2) is situated in a rolling line or upstream or downstream of the rolling line. A hot metal rolled material (1) is cooled in the cooling section. A control device (13) of the cooling section (2) dynamically determines setpoint actuation states (S1*) for control valves (10) situated in supply lines (8) and actuates the control valves (10) accordingly. Main flows (F1) of a liquid, water-based coolant (7) are supplied to application devices (6) of the cooling section (2) via the supply lines (8) in accordance with the actuation. The supply lines (8) conduct the main flows (F1) to buffer regions (12) of the application devices (6). Proceeding from there, cooling flows (F) of the coolant (7) are applied to the hot rolled material (1). The control device (13) also dynamically determines setpoint actuation states (S2*) for active devices (16) and actuates the active devices (16) accordingly. The active devices (16) conduct additional flows (F2) of a further medium (18) to the buffer regions (12) via further supply lines (17) in accordance with the actuation.

(Continued)

The cooling flows (F) depend on both the main flows (F1) and the additional flows (F2). The additional flows (F2) are positive or negative depending on the actuation state (S2*) of the active devices (16). The control device (13) adjusts the additional flows (F2) by correspondingly actuating the active devices (16) such that the cooling flows (F) are as identical as possible to setpoint flows (F*) of the coolant (7) at all times.

15 Claims, 4 Drawing Sheets

(56) References Cited

U.S. PATENT DOCUMENTS

| | | | | |
|---|---|---|---|---|
| 2012/0298224 | A1 | 11/2012 | Imanari et al. | 137/551 |
| 2016/0008861 | A1* | 1/2016 | Chen | B21B 45/0218 148/508 |

FOREIGN PATENT DOCUMENTS

| | | | |
|---|---|---|---|
| EP | 2 767 352 | A1 | 8/2014 |
| JP | S60-049803 | A | 3/1985 |
| JP | H02-229610 | A | 9/1990 |
| KR | 20120095274 | A | 8/2012 |

OTHER PUBLICATIONS

International Search Report dated Sep. 30, 2019 in corresponding PCT International Application No. PCT/EP2019/070427.

Written Opinion dated Sep. 30, 2019 in corresponding PCT International Application No. PCT/EP2019/070427.

European Search Report dated Feb. 25, 2019 in corresponding European Patent Application No. 18193920.8.

* cited by examiner

APPLICATION DEVICES FOR COOLING SECTIONS, HAVING A SECOND CONNECTION

CROSS-REFERENCE TO RELATED APPLICATIONS

The present application is a 35 U.S.C. §§ 371 national phase conversion of PCT/EP2019/070427, filed Jul. 30, 2019, the contents of which are incorporated herein by reference, which claims priority of European Patent Application No. 18193920.8 filed Sep. 12, 2018, the contents of which are incorporated by reference herein. The PCT International Application was published in the German language.

TECHNICAL FIELD

The present invention starts from an operating method for a cooling section arranged within a rolling train or upstream or downstream of the rolling train and by means of which a hot rolled product made of metal is cooled, wherein a control device of the cooling section dynamically determines a respective setpoint actuation state for a respective control valve arranged in a respective supply line and actuates the respective control valve accordingly, wherein a respective basic flow of a liquid, water-based coolant is fed to a number of application devices of the cooling section via the respective supply line in accordance with the actuation of the respective control valve by the control device, wherein the respective supply line feeds the respective basic flow to a respective buffer region of the respective application device, from which region a respective cooling flow of the coolant is applied to the hot rolled product by means of the respective application device.

The present invention furthermore starts from a control device for a cooling section which is arranged within a rolling train or upstream or downstream of the rolling train and by means of which a hot rolled product made of metal is cooled. For a number of application devices of the cooling section, the control device dynamically determines a respective setpoint actuation state for a respective control valve arranged in a respective supply line and actuates the respective control valve accordingly. As a result, a respective basic flow of a liquid, water-based coolant is fed to a respective buffer region of the respective application device via the respective supply line in accordance with the actuation of the respective control valve by the control device.

The present invention furthermore starts from a computer program comprising machine code that can be executed by a software-programmable control device for a cooling section. The execution of the machine code by the control device has the effect that, in accordance with the procedure just explained, the control device determines the respective setpoint actuation state for the respective control valve and actuates the respective control valve accordingly.

The present invention furthermore starts from a cooling section, wherein the cooling section is arranged within a rolling train or is arranged upstream or downstream of the rolling train, wherein a hot rolled product made of metal is cooled by means of the cooling section, wherein the cooling section has a number of application devices, which are connected to a source of a liquid, water-based coolant via a respective supply line, wherein a respective control valve is arranged in the respective supply line, wherein the application devices have a respective buffer region which is connected to the respective supply line, with the result that the respective supply line feeds a respective basic flow of the coolant to the respective buffer region of the respective application device and, starting from the respective buffer region, a respective cooling flow of the coolant is applied to the hot rolled product by means of the respective application device, wherein the cooling section has a control device which controls the respective control valve.

PRIOR ART

The abovementioned subject matter is common knowledge for those skilled in the art.

In the cooling section of a rolling mill, a metal rolled product is cooled after rolling. The rolled product can be made of steel or aluminum, for example. Depending on requirements, this can be a flat rolled product (strip or plate), a rolled product in the form of rods, or a profile. Precise temperature management in the cooling section is customary in order to establish desired material properties and to keep the properties constant with less scatter. Particularly in the case of a cooling section arranged downstream of the rolling train, a plurality of spray bars are installed for this purpose along the cooling section. By means of the bars, a liquid coolant, usually water, is applied to the rolled product from above and/or from below in order to cool the hot rolled product. It should be possible to adjust the quantity of water flowing through the respective spray bar as quickly as possible and as precisely as possible.

To adjust the quantities of water supplied to the spray bar, there is a known practice, for example, of arranging on-off valves or control valves in the supply lines. On-off valves can only be controlled in a purely binary way. They are therefore either fully open or fully closed. In contrast, control valves can be continuously adjusted, and it is therefore also possible to continuously adjust the quantity of water supplied to the respective spray bar.

Control valves can be configured as control flaps or as ball valves. Control flaps are relatively simple and inexpensive. However, they can be operated only with relatively small pressure differences, generally no more than 1 bar. Otherwise, cavitation phenomena occur, very quickly damaging the control flap. Control flaps are therefore not suitable, particularly for intensive cooling. However, they are often disadvantageous even in a laminar cooling section. In particular, they often exhibit a switching hysteresis. The switching hysteresis has the effect that the flap angle set is different for the same actuation, depending on whether the control flap is adjusted from a more fully open or more fully closed position to the new position to be adopted. Ball valves do not have a flap but have a ball with a hole in it, which is rotated in a pipe. Depending on the rotational position of the ball, a larger or smaller cross section is made available for the coolant to flow through. Ball valves can be operated with higher pressure differences of up to about 3 bar. With these valves, hysteresis does not occur or is negligibly small. However, ball valves are expensive.

In another solution, the coolant is supplied continuously to the spray bars. However, there is a controllable deflection plate. Depending on the position of the deflection plate, the coolant is either supplied to the rolled product or flows off at the side without contributing to the cooling of the rolled product. In this arrangement, rapid switching processes without pressure surges are possible. Continuous adjustment of the quantity of water is not possible, however. Moreover, the full coolant flow must be delivered continuously.

All types of valves and also the deflection plates require corresponding actuators. Pneumatically driven servomotors are conventional. A position control system is additionally required for control valves. This continuously compares the actual position of the respective control valve with its target position and adjusts the actual position until there is sufficient agreement with the target position.

Furthermore, common to all the arrangements is the fact that there must be an external coolant supply. The coolant can be taken from a gravity tank, for example, or can be transported in via a relatively large pipeline from a remote pumping station. Combinations of these approaches are also possible. In "intensive cooling", for example, water is often initially taken from a gravity tank. The pressure is then increased to a variable extent by means of booster pumps and thereby made available with a correspondingly variable pressure for intensive cooling. The intensive cooling system is provided with a plurality of spray bars, and starting from the booster pumps, the coolant is supplied individually via a respective supply line. Ball valves are arranged in the supply lines, which are actuated to adjust the quantity of coolant supplied to the respective spray bar.

Various disadvantages arise in the prior art.

In on-off valves, there are pressure shocks when switching the valves off. It is therefore not possible to switch off on-off valves as quickly as might be desired. Normal switching times are above 1 second, and sometimes up to 2 seconds.

With control flaps and ball valves, similar control times are achieved. Moreover, a position control system is required for each control valve. The achievable accuracy is about 1% to 2%.

In control valves, there are also pressure shocks when switching off. It is therefore not possible to switch off control valves as quickly as might be desired either. Normal switching times are in the region of about 1 second.

US 2012/0 298 224 A1 discloses the predictive operation of a pump in the context of a rolling mill with a downstream cooling section. However, this pump does not directly feed the application devices by means of which the cooling medium is applied to the hot rolled product but delivers the cooling medium only into a reservoir so that the latter is always adequately filled. The application of the coolant to the rolled product itself is not explained specifically.

SUMMARY OF THE INVENTION

It is the object of the present invention to create possibilities by means of which a cooling section with superior operating characteristics is achieved in a simple and reliable manner.

The object is achieved by means of an operating method disclosed herein.

According to the invention, an operating method of the type stated at the outset is embodied in such a way that the control device additionally dynamically determines a respective further setpoint actuation state for a respective active device and actuates the respective active device accordingly, that the respective active device feeds a respective additional flow of a further medium to the respective buffer region via a respective further supply line in accordance with the actuation of the respective active device by the control device, that the respective cooling flow depends both on the respective basic flow flowing through the respective control valve and on the respective additional flow flowing via the respective active device, that the respective additional flow is positive or negative depending on the respective further actuation state of the respective active device, and that the control device sets the respective additional flow in such a way, by correspondingly actuating the respective active device, that the respective cooling flow is approximated as closely as possible at all times to a respective setpoint flow to be applied to the hot rolled product by means of the respective application device.

Given appropriate configuration, the respective active device can be operated in a considerably more dynamic way than a control valve. As in the prior art, it is therefore possible to use control valves in the supply lines to the application devices and to actuate the valves accordingly. Despite the relatively long delay times in the correction of the setting of the control valves, it is nevertheless possible to set the cooling flows with a relatively short delay time and thus in a highly dynamic way by virtue of the more dynamic characteristics of the active devices.

Depending on the actuation state of the respective active device, it is possible, for example, to briefly increase or lower the pressure in the buffer region of the respective application device. During increased pressure, more coolant briefly flows out of the respective buffer region as a respective cooling flow than is fed to the respective buffer region as a respective basic flow. In the case of a lowered pressure, the situation is reversed. When averaged over time, however, the cooling flow and the basic flow correspond to one another.

In the simplest case, the respective active device is designed as a pair of air valves, of which one is connected to a pressure reservoir and one is connected to the environment, respectively.

Although this configuration is possible in principle, it is not the preferred one. On the contrary, it is preferred that the respective active device actively delivers the further medium.

In particular, the further medium can be air or water. In the case of air, the device actively delivering the further medium is a blower, an air pump or a turbine. In the case of water, the device actively delivering the further medium is a pump.

In the case of air, it is possible to draw air directly from the environment and—in the case of a negative additional flow to discharge it directly to the environment. Alternatively, the further medium can be taken from a respective storage device. In this case, the further medium can be air or water.

It is possible for the further medium in the respective storage device to not be under a respective pressure. This is possible, in particular, when the further medium is water and there is in the upper region of the respective storage device an air cushion communicating via an opening with the environment. This enables air to flow into the respective storage device or to flow out of the respective storage device according to requirements. Alternatively, it is possible for the further medium in the respective storage device to be under a respective pressure. This makes it possible, in particular, to keep small the adjustment range that has to be managed by the active device.

The respective pressure in the respective storage device is preferably set via a respective control line connected to the respective storage device. This makes it possible to set the pressure in the respective storage device, in any static operating state of the respective application device, in such a way that the respective active device has to consume as little energy as possible for the highly dynamic setting of the respective cooling flow. In particular, it is possible that the respective pressure in the respective storage device is corrected in accordance with the setpoint flow or with a respective pressure prevailing in the respective buffer region. In this case, it is even possible to set any static operating state of the respective application device without the respective active device having to consume energy to maintain this state.

The object of the invention stated above is furthermore achieved by means of a control device having the features as disclosed herein.

According to the invention, a control device of the type stated at the outset is embodied such that the control device additionally dynamically determines a respective further setpoint actuation state for a respective active device and actuates the respective active device accordingly. This has the result that the respective active device feeds a respective additional flow of a further medium to the respective buffer region via a respective further supply line in accordance with the actuation of the respective active device by the control device, a respective cooling flow of the coolant emanating from the respective buffer region and applied to the hot rolled product by means of the respective application device depends both on the respective basic flow flowing through the respective control valve and on the respective additional flow flowing via the respective active device, and the control device sets the respective additional flow to positive and negative values in such a way that the respective cooling flow is approximated as closely as possible at all times to a respective setpoint flow to be applied to the hot rolled product by means of the respective application device.

If the further medium is taken from a respective storage device and is under a respective pressure in the respective storage device, the control device preferably sets the respective pressure in the respective storage device via a respective control line connected to the respective storage device. It is thereby possible to reduce the energy consumption of the respective active device in every static operating state of the respective application device. This applies very particularly if the control device corrects the pressure in the respective storage device in accordance with the setpoint flow or with a pressure prevailing in the respective buffer region. In this ideal case, the energy consumption can even be reduced to 0.

The control device is preferably configured as a software-programmable device which is programmed with a computer program comprising machine code as disclosed herein that can be executed by the control device. In this case, the execution of the machine code by the control device effects the corresponding determination of the respective setpoint actuation state for the respective control valve and of the respective further setpoint actuation state for the respective active device and the corresponding actuation of the respective control valve and of the respective active device.

The object is furthermore achieved by means of a computer program as disclosed herein. According to the invention, the execution of the computer program by a software-programmable control device of the type stated at the outset has the effect that, in accordance with the procedure according to the invention, the control device determines the respective setpoint actuation state for the respective control valve and the respective further setpoint actuation state for the respective active device and actuates the respective control valve and the respective active device accordingly.

The object is furthermore achieved by means of a cooling section as disclosed herein.

According to the invention, a cooling section of the type stated at the outset is embodied in such a way that the respective buffer region is assigned a respective active device, by means of which an additional flow of a further medium can be fed to the buffer region via a further supply line. The result is that the respective cooling flow depends both on the basic flow through the respective control valve and on the respective additional flow via the respective active device, and the cooling section has a control device as disclosed herein which controls not only the respective control valve but additionally also controls the respective active device.

It is thereby possible to achieve the same advantages as for the operating method.

The advantageous embodiments of the cooling section and also the advantages thereby brought about are already the subject matter hereof relating to the operating method.

BRIEF DESCRIPTION OF THE DRAWINGS

The above-described properties, features and advantages of this invention and the manner in which these are achieved will become more clearly and distinctly comprehensible in conjunction with the following description of the illustrative embodiments, which are explained in greater detail in combination with the drawings. Here, in schematic illustration.

DESCRIPTION OF THE EMBODIMENTS

Figure 1:
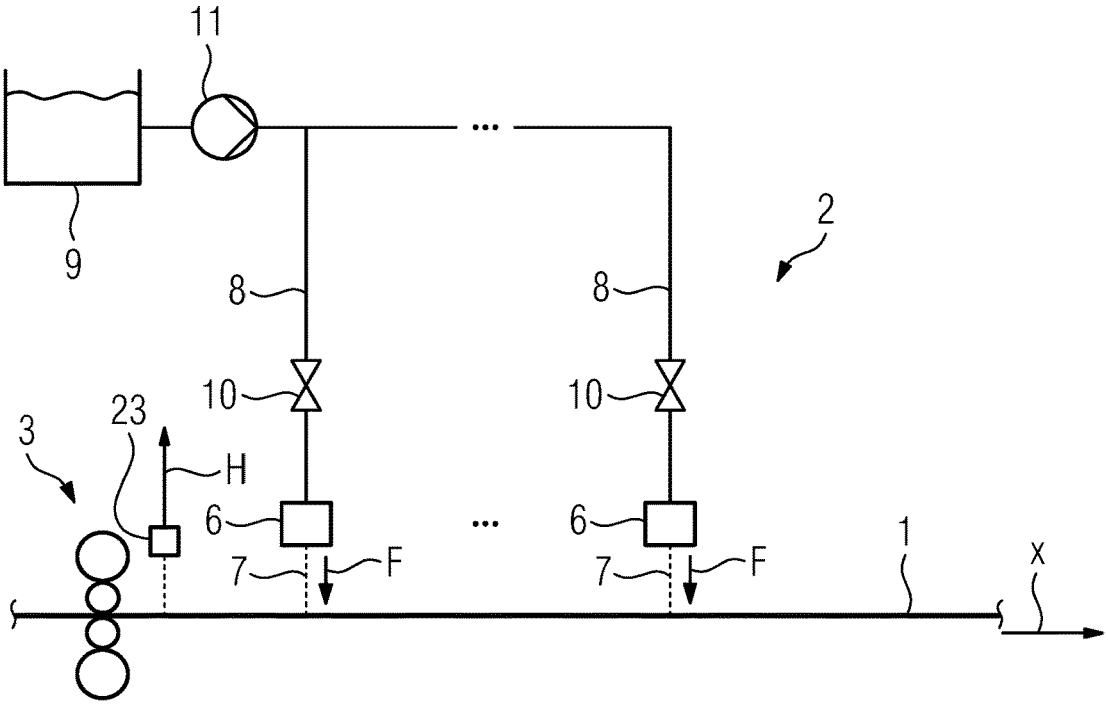
FIG. 1 shows a cooling section arranged downstream of a rolling train.

According to FIG. 1, a hot rolled product 1 made of metal is to be cooled in a cooling section 2. According to FIG. 1, the cooling section 2 is arranged downstream of a rolling train. FIG. 1 illustrates just one rolling stand 3 of the rolling train, namely the last rolling stand 3 of the rolling train. In general, however, the rolling train has a plurality of rolling stands 3, through which the hot rolled product 1 runs sequentially in succession. In the case of the embodiment shown in FIG. 1, the hot rolled product 1 enters the cooling section 2 immediately after rolling in the last rolling stand 3 of the rolling train. A time interval between rolling in the last rolling stand 3 of the rolling train and entry to the cooling section 2 is generally in the region of a few seconds.

Figure 2:
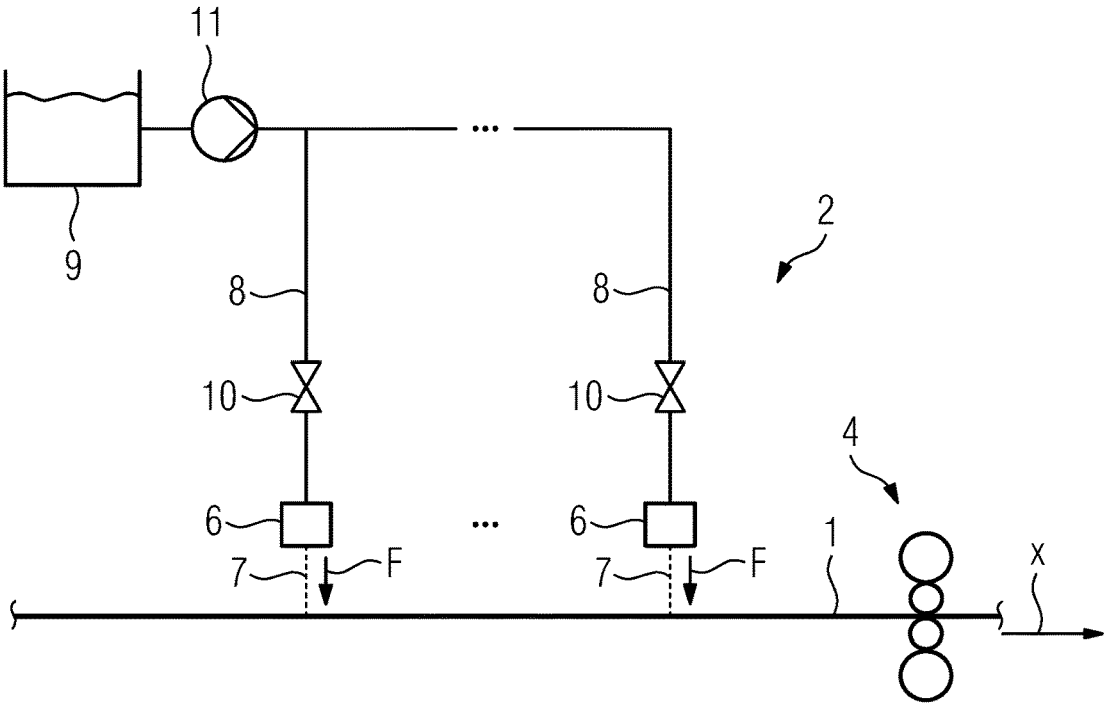
FIG. 2 shows a cooling section arranged upstream of a rolling train.

Alternatively, the cooling section 2 could be arranged upstream of the rolling train in accordance with the illustration in FIG. 2. FIG. 2 likewise illustrates just one rolling stand 4 of the rolling train, namely the first rolling stand 4 of the rolling train. In the case of the embodiment shown in FIG. 2, the hot rolled product 1 is rolled in the first rolling stand 4 of the rolling train immediately after exiting from the cooling section 2. A time interval between cooling in the cooling section 2 and rolling in the first rolling stand 4 of the rolling train is often in the region of a few minutes. However, it may also be just a few seconds.

Figure 3:
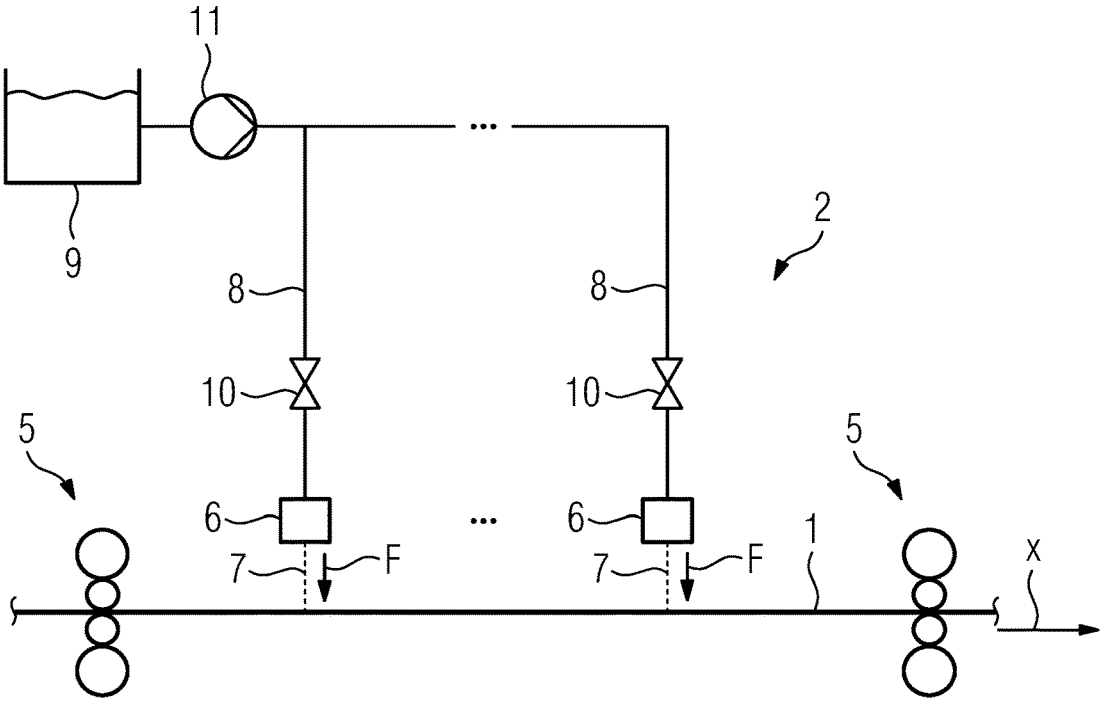
FIG. 3 shows a cooling section arranged within a rolling train.

Alternatively, the cooling section 2 could be arranged within the rolling train in accordance with the illustration in FIG. 3. FIG. 3 illustrates two rolling stands 5 of the rolling train. In this case, cooling in the cooling section 2 takes place between rolling in the two rolling stands 5 of the rolling train. A time interval between cooling in the cooling section 2 and rolling in the two successive rolling stands 5 of the rolling train is in the region of a few seconds. According to the illustration in FIG. 3, the cooling section 2 is arranged between two successive rolling stands 5 of the rolling train. However, it could also extend over a larger range, and therefore the cooling section 2 is subdivided into a corresponding number of segments by at least one further rolling stand (not illustrated in FIG. 3).

The rolled product 1 is made of metal. The rolled product 1 can be made of steel or aluminum, for example. Other metals are also possible. In the case of steel, a temperature of the rolled product 1 ahead of the cooling section 2 is in general between 750° C. and 1200° C. In the cooling section 2, cooling to a lower temperature is performed. In individual cases, it is possible for the lower temperature to be only slightly below the temperature ahead of the cooling section 2. Particularly in the case where the cooling section 2 is arranged downstream of the rolling train, however, the rolled product 1 is generally cooled to a significantly lower temperature, e.g. to a temperature of between 200° C. and 700° C.

The hot rolled product 1 is fed to the cooling section 2 in a horizontal transport direction x. As it passes through the cooling section 2, the transport direction x of the hot rolled product 1 does not change. Thus, transport is also horizontal within the cooling section 2. After leaving the cooling section 2, the rolled product 1 can either retain or change transport direction. If the hot rolled product 1 is a strip, it may be deflected obliquely downward, for example, in order to feed it to a coiler. It is furthermore possible for the hot rolled product 1 to reverse its transport direction x, to pass through the cooling section 2 again and then to be rolled again. This is possible both in the case of plate and in the case of a roughed slab.

The cooling section 2 has a number of application devices 6. The application devices 6, applied a coolant 7 to the rolled product 1. According to the illustration in FIGS. 1 to 3, the coolant 7 is applied to the rolled product 1 from above. However, it would likewise also be possible, either as an alternative or in addition, for application to take place from below and/or from the side. The coolant 7 is water. Additives may optionally be added in small quantities to the water (a maximum of 1 percent to 2%). In all cases, however, the coolant 7 is a water-based liquid coolant. The application devices 6 can be configured as conventional spray bars, for example.

At the minimum, there is a single application device 6. In many cases, however, there are a plurality of application devices 6. The application devices 6 can be arranged in series in accordance with the illustration in FIG. 1, for example. In this case, the application devices 6 apply their respective proportion of the coolant 7 sequentially in succession to the rolled product 1. In this context, the term "sequentially in succession" relates to a particular segment of the rolled product 1 since this segment passes sequentially in succession through regions in which the individual application devices 6 apply their respective proportion of the coolant 7 to the corresponding segment of the rolled product 1. The number of application devices 6 is often in the two-figure range, sometimes even in the upper two-figure range, and in rare cases also in the three-figure range. A sequential arrangement in succession is generally implemented particularly when the cooling section 2 is arranged downstream of the rolling train. However, it can also be present in other scenarios.

The application devices 6 are connected via a respective supply line 8 to a reservoir 9 for the coolant 7 (or to some other source for the coolant 7). In the present case, the reservoir 9 is the same for all the application devices 6. However, it would also be possible for there to be a plurality of mutually independent reservoirs 9. A respective control valve 10 is arranged in each supply line 8. In principle, the control valves 10 can be arranged at any points within the supply lines 8. In practice, however, it is advantageous if the control valves 10 are arranged as close as possible to application devices 6. If necessary, one or more pumps 11 can be arranged upstream of the control valves 10. The operation of the pump 11 or pumps 11 is not part of the subject matter of the present invention.

The operation of one of the application devices 6 is explained in greater detail below, as a representative example of all the application devices 6, in conjunction with FIG. 4. In principle, the other application devices 6 are operated in the same way. However, the respective mode of operation for each application device 6 can be determined individually. It is therefore possible but not necessary to operate the application devices 6 in the same way. It is also possible for some of the application devices 6 to be operated in a different way from that according to the invention.

The application device 6 is supplied with a basic flow F1 of the coolant 7 from the reservoir 9 via the supply line 8 and the control valve 10. The basic flow F1 has the units $m^3/s$. The supply line 8 is connected to a buffer region 12 of the application device 6. As a result, basic flow F1 is fed first of all to the buffer region 12 of the application device 6. For example, the application device 6 may be designed, in accordance with the illustration in FIG. 4, as a spray bar, which has a certain storage volume, wherein the storage volume is filled to a variable extent with the coolant 7 and otherwise with air.

Starting from the buffer region 12, a cooling flow F is applied to the hot rolled product 1 by means of the application device 6. A distance of the application device 6, e.g. of spray nozzles, from the rolled product 1 is generally between 20 cm and 200 cm.

The cooling section 2 is controlled by a control device 13. In general, the control device 13 is configured as a software-programmable control device. In this case, the control device 13 is programmed with a computer program 14. The computer program 14 comprises machine code 15 that can be executed directly by the control device 13. The execution of the machine code 15 by the control device 13 has the effect in this case that the control device 13 carries out an operating method for the cooling section 2, as explained in greater detail below.

The control device 13 dynamically determines a setpoint actuation state S1* for the control valve 10. It controls the control valve 10 accordingly. By actuating the control valve 10 in accordance with the setpoint actuation state S1* determined, the control device 13 sets the basic flow F1, which is fed to the application device 6 via the supply line 8 and the control valve 10.

The control device 13 of the cooling section 2 knows a setpoint flow F* which is to be applied to the hot rolled product 1 by means of the application device 6. The setpoint flow F* is generally not constant with respect to time but is variable, i.e. is a function of time. It is possible for the control device 13 to determine the setpoint actuation state S1* for the control valve 10 in accordance with the setpoint flow F* of the coolant 7. In this case, the control device 13 can determine the actuation state S1* in such a way, for example, that the basic flow F1 flowing through the control valve 10 is approximated as far as possible to the setpoint flow F* at all times in every operating state. The operation of the control valve 10 then corresponds to the mode of operation in the prior art. However, other procedures are also possible. Further details of this will be given below.

In addition, the buffer region 12 is assigned an active device 16. The active device 16 is connected to the buffer region 12 via a further supply line 17. The term "active device" means that the control device 13 actuates the active device 16 in accordance with a setpoint actuation state S2* and that the active device 16 responds accordingly. The control device 13 also dynamically determines the further setpoint actuation state S2* and actuates the active device 16 accordingly. The setpoint actuation state S2* for the active device 16 is referred to below as the further setpoint actuation state S2* to distinguish it from the setpoint actuation state S1* for the control valve 10. In accordance with the actuation of the active device 16 by the control device 13, the active device 16 thereby feeds an additional flow F2 of a further medium 18 to the buffer region 12 via the further supply line 17. Similarly to the basic flow F1, the additional flow F2 has the units $m^3/s$. It can be positive or negative. Thus, as alternatives, it is possible to feed the further medium 18 to the buffer region 12 or to withdraw it from the buffer region 12. Whether the additional flow F2 is positive or negative depends on the further setpoint actuation state S2*. Irrespective of the respective specific value of the additional flow F2 and also irrespective of the type of further medium 18, the cooling flow F thus depends not only on the basic flow F1 flowing through the control valve 10 but additionally also on the additional flow F2 flowing via the active device 16.

The present invention is based on the principle that the control device 13 sets the additional flow F2 in such a way, by means of corresponding actuation of the active device 16, that the cooling flow F is approximated as far as possible to the setpoint flow F* at all times.

In order to be able to determine the further setpoint actuation state S2*, various values must be known to the control device 13. On the one hand, there is the setpoint flow F*. The setpoint flow F* can be specified to the control device 13, for example, or can be determined by the control device 13 from other data—e.g. the temperature or enthalpy of a certain segment of the rolled product 1 in conjunction with a desired time profile of the temperature or of the enthalpy. If, as is the case with the embodiment shown in FIG. 4, the further medium 18 is air, the control device 13 must know a nominal flow F0 and an associated nominal pressure p0. The nominal flow F0 is the quantity of coolant 7 which is applied to the hot rolled product 1 from the buffer region 12 per unit time when the nominal pressure p0 prevails in the buffer region 12. The values F0, p0 can be determined in advance by a one-time measurement, for example.

If a rapid increase in the setpoint flow F* occurs in such a case, for example, it is possible, by means of the relation $$p = \frac{F^{*2}}{F0^2} \cdot p0 \tag{1}$$

to determine the associated required pressure p that must prevail in the buffer region 12. The nominal flow F0 is the quantity of coolant 7 which is applied to the hot rolled product 1 from the buffer region 12 per unit time when the nominal pressure p0 prevails in the buffer region 12. The control device 13 thus actuates the active device 16 in such a way that it gives rise to the pressure p in the buffer region 12.

The active device 16 is preferably a device that actively delivers the further medium 18, e.g. a turbine. In this case, the turbine is driven by an electric drive. The drive can be converter-controlled, for example. Such control systems are a matter of common knowledge to those skilled in the art and therefore do not need to be explained in more detail. An electric drive can typically be accelerated with a time constant of 0.1 s from 0 to maximum speed and, conversely, can also be decelerated with a time constant of 0.1 seconds from the maximum speed to 0.

The active device 16 can thus be actuated in a highly dynamic way. The full adjustment range (e.g. from 0 to maximum speed) can typically be traversed in a time window of less than 0.2 s. Often, only 0.1 s or less may even be required. With this short time constant, the cooling flow F can thus be adapted even though the control valve 10 has only relatively low dynamic performance, e.g. a time constant of 1.5 s. During this time period, the basic flow F1 thus does deviate from the desired setpoint flow F*. However, this time delay does not have a noticeable effect on the cooling flow F because the pressure p in the buffer region 12 can be set in a highly dynamic way by means of the turbine when required.

The additional flow F2 can be positive or negative. If it is positive, the turbine pumps air into the buffer region 12, thus increasing the pressure p in the buffer region 12. If it is negative, the turbine draws air out of the buffer region 12, thus reducing the pressure p in the buffer region 12. However, the cooling flow F does not depend directly on the basic flow F1 but on the pressure p in the buffer region 12. It must merely be ensured that there is in fact coolant 7 in the buffer region 12 that can be applied to the hot rolled product 1.

The basic flow F1 does not have to follow the setpoint flow F* directly. It must merely be set in such a way that the buffer region 12 neither empties nor overflows. As already mentioned, it is possible to this end to determine the setpoint actuation state S1* in accordance with the setpoint flow F*, as in the prior art. As an alternative, it is possible, for example, to determine a filling level of the buffer region 12 and to adjust it to a certain setpoint value. The setpoint value can be constant or can vary, depending on requirements. In this case, the filling level can be measured directly or indirectly, for example. Indirect measurement is possible by means of pressure cells, for example, by means of which the weight of the application device 6 is detected. The filling level can also be determined from the basic flow F1 and the cooling flow F with the assistance of a model. The difference between the basic flow F1 and the cooling flow F corresponds to the change in the filling level at each point in time. It is thus possible at any time, by integrating this difference over time, to determine the instantaneous filling level on the basis of a known initial filling level. The basic flow F1 can be measured, for example, while the cooling flow F can be determined from the pressure p, which can easily be measured.

To determine the setpoint actuation state S2* for the active device 16, the control device 13 can proceed as follows, for example:

Let the buffer region 12 have a total volume V. Let the buffer region 12 be partially filled with the coolant 7, and otherwise with air. V1 below denotes the volume occupied by the coolant 7, and V2 denotes the air volume. Naturally, the following relation applies:

$$V=V1+V2 \tag{2}$$

Let the prevailing pressure in the air volume V2 be p. The pressure prevailing in the coolant 7 is also p. The basic flow F1 flows into the buffer region 12 via the control valve 10 and the supply line 8. The basic flow F1 can be determined from the relation:

$$F1 = FR\cdot\sqrt{\frac{p1-p}{p0}}\cdot f(x) \tag{3}$$

FR is a reference flow of the coolant 7 that flows when the control valve 10 is fully open if the pressure difference between the inlet side of the control valve 10 and the buffer region 12 is equal to the nominal pressure p0. The value FR can be determined in advance by one-time measurement, for example. p1 is the pressure on the inlet side of the control valve 10. f(x) is the relative flow rate of the control valve 10 as a function of the valve position x of the control valve 10. For x=0 (control valve 10 fully closed), it is 0, and for x=1 (control valve 10 fully open), it is 1. Between x=0 and x=1, it rises monotonically—often in a strictly monotonic way. The characteristic curve f as such can be determined in advance. In general, it is determined by a one-time procedure in advance by the manufacturer of the control valve 10 and can then be taken from the datasheet of the control valve 10.

For the change in the volume V1 occupied by the coolant 7, the following applies:

$$\dot{V}1=F1-F$$

For the air quantity M contained in the air volume V2, the following applies:

$$M=p\cdot V2 \tag{5}$$

Here, it is assumed that the temperature of the air is constant. If the temperature is variable, calculation is admittedly somewhat more complex but remains similar in principle.

By means of the additional flow F2, a change in the air quantity M and hence in the air volume V2 and/or in the pressure p is brought about in the buffer region 12. Thus, the following applies:

$$\dot{M} = \dot{p}\cdot V2 + p\cdot\dot{V}2 = \frac{\dot{p}}{p}\cdot M - p\cdot(F1-F)$$

By substituting equation (1) and equation (3), the following relation can thus be determined as the resulting equation for the change in the air quantity M with respect to time:

$$\dot{M} = \frac{\dot{p}}{p}\cdot M + p\cdot\left(\sqrt{\frac{p}{p0}}\cdot F0 - \sqrt{\frac{p1-p}{p0}}\cdot FR\cdot f(x)\right)$$

The characteristic curve K of the turbine is furthermore known to the control device 13. The characteristic curve K relates the speed n of the turbine, the pressure difference δp on the inlet side and outlet side of the turbine, and the air quantity delivered per unit time, i.e. the time derivative of the air quantity M, to one another. If two of the three variables—speed n of the turbine—pressure difference δp—time derivative of the air quantity M—are specified, the respective third variable is determined from the characteristic curve K. The characteristic curve K can be determined by measurement or from a datasheet of the manufacturer of the turbine, for example. Thus, it is possible to specify a function by means of which, for a given pressure difference δp and a given time derivative of the air quantity M, the associated speed n of the turbine can be determined. The required pressure difference δp results directly from the desired setpoint flow F*. With the time derivative of the air quantity M, the additional flow F2 is also determined.

As a result, the speed n of the turbine is thus determined by the following relation:

$$n = K\left(p, \frac{\dot{p}}{p}\cdot M + p\cdot\left(\sqrt{\frac{p}{p0}}\cdot F0 - \sqrt{\frac{p1-p}{p0}}\cdot FR\cdot f(x)\right)\right)$$

This equation is dependent exclusively on the pressure p in the buffer region 12, the position x of the control valve 10, the instantaneous air quantity M, and the time derivative of the pressure p in the buffer region 12. The remaining variables are merely constant parameters. The air quantity M is a state variable which can be determined easily by means of a monitor. For this purpose, all that is required is to solve the equation (7) with a suitable initial value.

Monitors are sufficiently well known in the prior art. Purely by way of example, attention is drawn to the textbook "Systemtheorie—eine Einführung" [System Theory—An Introduction] by R. Unbehauen, Volume 1, Springer Verlag Berlin, Heidelberg, Germany. The other variables are easy to measure or—in the case of the time derivative of the pressure p—can be readily derived from the measured pressure p.

The pressure p in the buffer region 12 and hence ultimately the cooling flow F can therefore be set as quickly as the speed n of the turbine. However, it is possible to set the speed of the turbine with an accuracy of 1% and better, with a time constant of 0.2 s and better.

Care must merely be taken to ensure that the volume V1 of the coolant 7 in the buffer region 12 remains within the permissible limits. However, this is readily achievable. All that is required is to correct the position x of the control valve 10 continuously in an appropriate manner, ensuring that the volume V1 tends towards a predetermined setpoint value. Appropriate controllers are widely known. The controller can be designed as a P controller, as a PI controller or as a state controller, for example, all with or without feedforward control. Implementation as a two-point controller is also possible.

Figure 4:
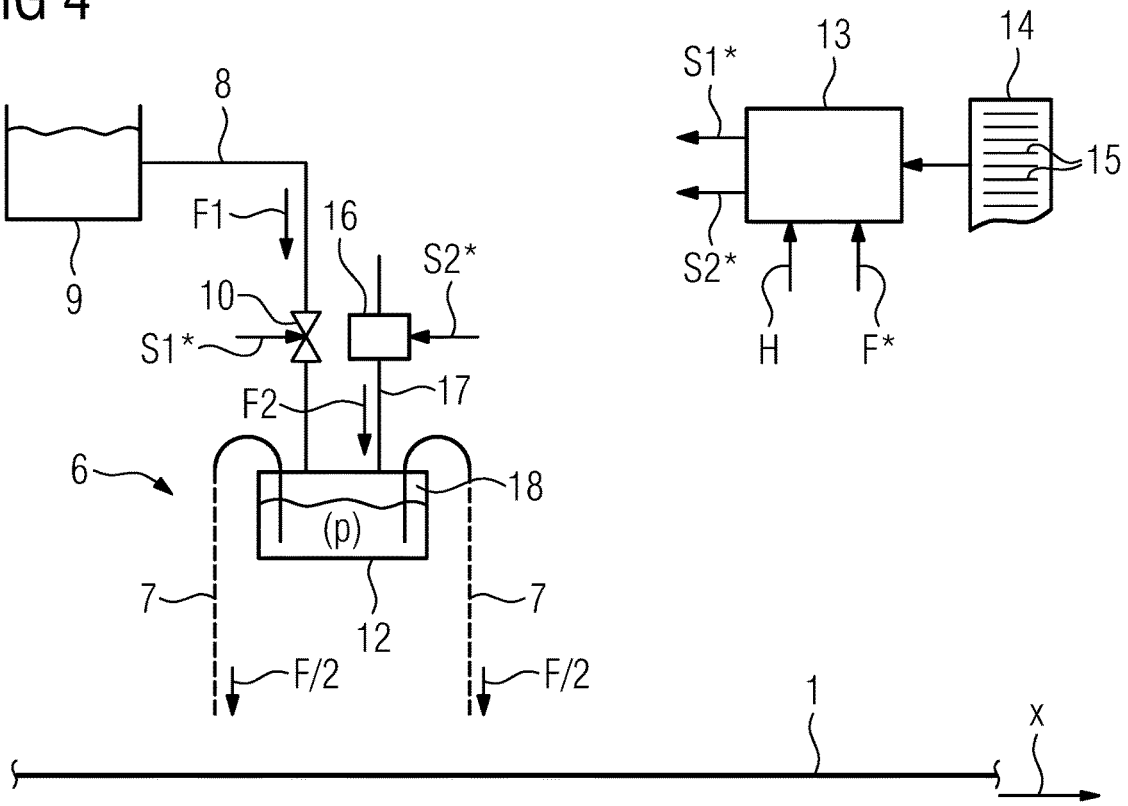
FIG. 4 shows a single application device.

In the case of the embodiment shown in FIG. 4, the active device 16 simply takes the air from the environment and discharges it to the environment. As an alternative, in accordance with the illustration in FIG. 5, it is possible for the active device 16 to take the air from a storage device 19 and discharge it into the storage device 19. In other respects, the embodiment in FIG. 5 coincides with the embodiment in FIG. 4. As compared with the embodiment in FIG. 4, the embodiment in FIG. 5 has the advantage that the air in the storage device 19 can be under a pressure p'. The pressure p' is preferably chosen so that it is between 0 and a maximum pressure, wherein the maximum pressure is the pressure at which the application device 6 is operated at the maximum output.

If the dimensions of the storage device 19 are sufficiently large, it is possible for the pressure p' to be approximately constant. In this case, the pressure p' should be approximately half the maximum pressure. If the storage device 19 is of smaller dimensions, the pressure p' in the storage device 19 decreases in accordance with the air quantity removed and increases again in accordance with the air quantity fed in. This may well be advantageous since a pressure rise in the storage device 19 counteracts an excessive reduction in the air volume V2 in the buffer region 12 and vice versa.

Figure 5:
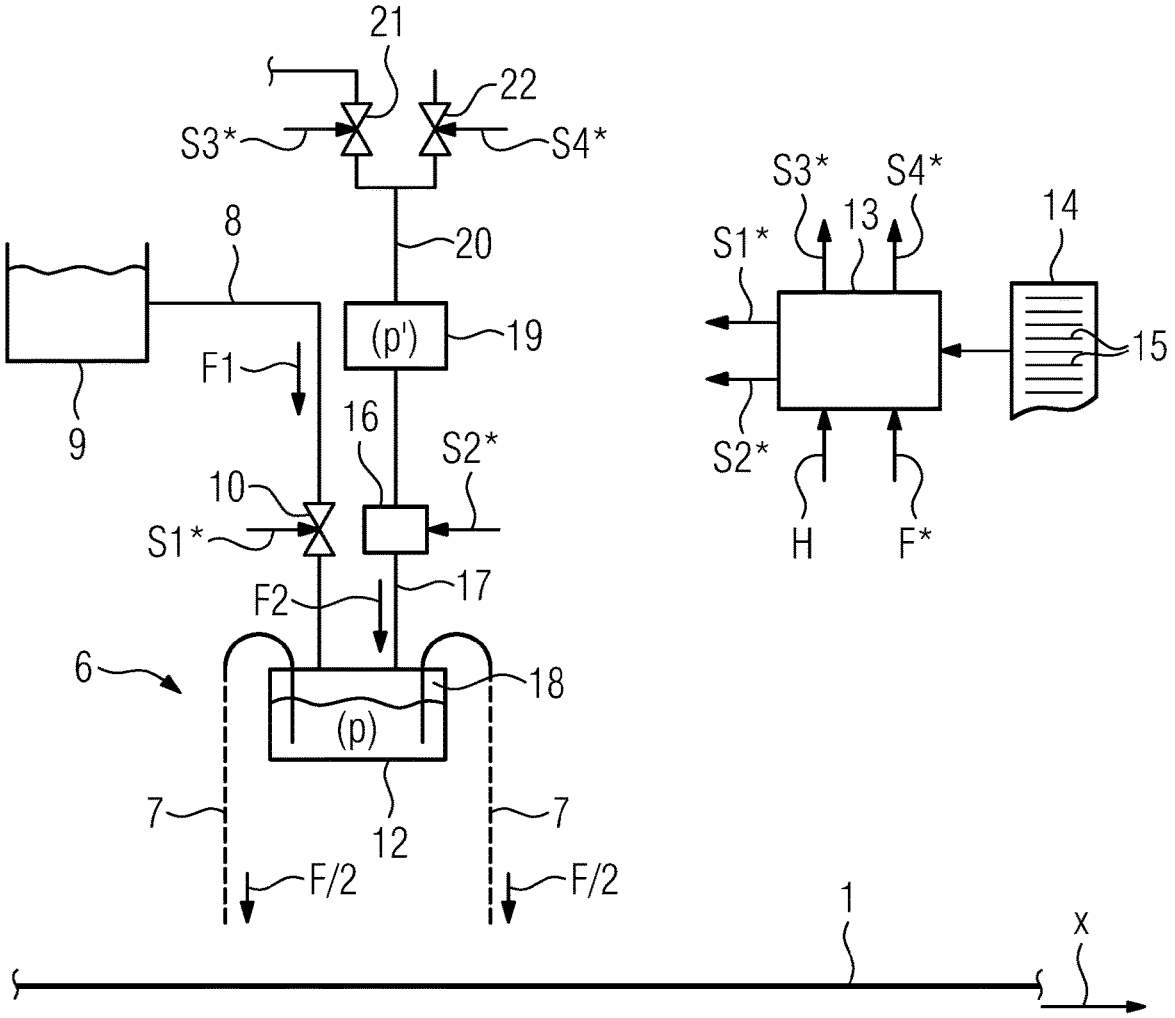
FIG. 5 shows a modification of the application device in FIG. 4.

As an alternative, in accordance with the illustration in FIG. 5, it is possible for the control device 13 to set the pressure p' via a control line 20 connected to the storage device 19. In this case, it is possible, in particular, for the control device 13 to correct the pressure p' in accordance with the setpoint flow F* or the pressure p. For example, the control device 13 can actuate valves 21, 22 with corresponding control signals S3*, S4*, with the result that—depending on the actuation of the valves 21, 22—compressed air is fed to the storage device 19 or air is discharged from the storage device 19 into the environment, according to requirements.

Due to the pressure p', the actuation of the turbine changes, since the pressure difference δp is the crucial factor in the front argument of the characteristic curve K. In other respects, the derivation of the required speed n of the turbine remains unchanged. All that is required is to determine the speed n of the turbine from the following relation:

$$n = K\left(p - p',\ \frac{p}{p} \cdot M + p \cdot \left(\sqrt{\frac{p}{p0}} \cdot F0 - \sqrt{\frac{p1 - p}{p0}} \cdot FR \cdot f(x)\right)\right)$$

The embodiment in FIG. 5 offers various advantages over the embodiment in FIG. 4. On the one hand, the turbine is always operated in a clean air environment. On the other hand, the energy consumption of the turbine can be reduced by setting the pressure p' according to requirements. This can be worthwhile especially when the cooling flow F and hence the required pressure p in the buffer region 12 remain constant or at least substantially constant for a prolonged time.

Both in the embodiment shown in FIG. 4 and in the embodiment shown in FIG. 5, the coolant 7 must be taken from the application device 6 at a relatively low point since—of course—the air volume V2 is in the upper region and the volume V1 of the coolant 7 is in the lower region of the buffer region 12. However, this is readily possible.

The embodiment in FIGS. 4 and 5 is expedient especially in the case of a laminar cooling section. In principle, however, it can also be implemented in the case of intensive cooling.

Figure 6:
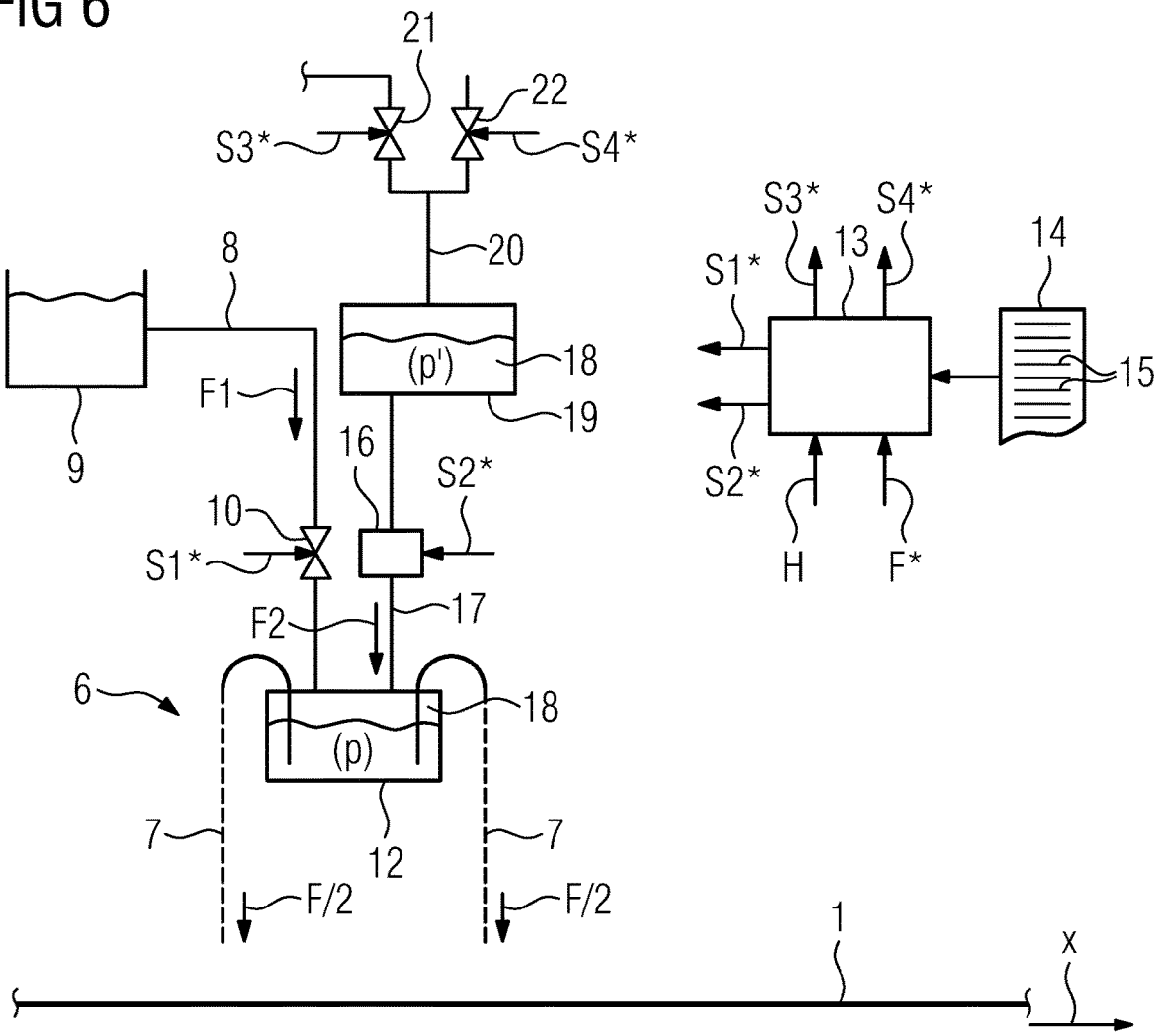
FIG. 6 shows a further application device.

The embodiment in FIG. 6 corresponds in large areas with that in FIG. 5. In the embodiment in FIG. 6 too, the active device 16 is preferably a device which actively delivers the further medium 18. In the embodiment in FIG. 6, the further medium 18 is not air, however, but water (or more generally the cooling medium 7). The active device 16 is therefore a pump. Similarly to the turbine in FIGS. 4 and 5, the pump is driven by an electric drive. The drive can be converter-controlled, for example. An electric drive can typically be accelerated with a time constant of 0.1 s from 0 to maximum speed and, conversely, can also be decelerated with a time constant of 0.1 seconds from the maximum speed to 0. Depending on the speed and direction of rotation, it is thus possible, by means of the pump, to feed additional water to the buffer region 12 in addition to the basic flow F1 fed in via the supply line 8, or to remove some of the basic flow F1 fed in via the supply line 8 from the buffer region 12, in a highly dynamic way according to requirements. In this case, the cooling flow F is obtained directly as the sum of the basic flow F1 and the additional flow F2, wherein the latter can be positive or negative depending on the actuation of the pump.

In the embodiment shown in FIG. 6, the further medium in the storage device 19 is preferably also under pressure p'. In the embodiment shown in FIG. 6 too, the control device 13 furthermore preferably sets the pressure p' via a control line 20 connected to the storage device 19. Via the control line 20, compressed air is preferably fed to the storage device 19, or air is discharged from the storage device 19. Just as in the embodiment shown in FIG. 5, the control device 13 can correct the pressure p' as a function of the pressure p.

The control device 13 can determine the setpoint actuation state S2* for the pump as follows, for example:

As before, the pressure p required to ensure that the cooling flow F is equal to the setpoint flow F* can be determined in accordance with equation (1). The basic flow F1 also continues to obey equation (3). However since, in the case of the embodiment shown in FIG. 6, the buffer region 12 is always completely full of coolant 7 or water (=further medium 18), it is at all times the case that the sum of the basic flow F1 and the additional flow F2 is equal to the cooling flow F. In order to set the cooling flow F to the setpoint flow F*, it is therefore necessary to comply at all times with the relation $$F2 = F^* - F1 \tag{10}$$

Analogously to the above statements relating to the characteristic curve K of the turbine, there is a similar characteristic curve K for the pump. The change in the air quantity with respect to time is merely replaced by the volume flow delivered, i.e. the additional flow F2. With the known pressure p in the buffer region 12, the pressure p' in the storage region 19, and the required additional flow F2, it is therefore immediately possible, in accordance with the relation $$n = k\left(p - p',\ \sqrt{\frac{p}{p0}} \cdot F0 - \sqrt{\frac{p1 - p}{p0}} \cdot FR \cdot f(x)\right) \tag{11}$$

to determine the required speed n of the pump.

Analogously to the embodiments in FIGS. 4 and 5, care must be taken to ensure that the basic flow F1 corresponds, when averaged over time, to the cooling flow F. The procedure can be implemented in a manner similar to that for the embodiments in FIGS. 4 and 5.

The embodiment in FIG. 6 is expedient especially in the case of intensive cooling. In principle, however, it can also be implemented in the case of a laminar cooling section.

Both in the case of the embodiments in FIGS. 4 and 5 and in the embodiment in FIG. 6, it is expedient to actually measure the position x of the control valve 10. This is readily possible. It is also expedient and easy to measure the pressure p in the buffer region 12. Measurement of the pressure p' in the storage device 19 is possible but not necessary. In the embodiments in FIGS. 4 and 5, it is furthermore expedient also to measure the amount of coolant 7 in the buffer region 12. Apart from the possibilities already mentioned, it is also possible to measure the filling level directly, e.g. by means of a float, an ultrasonic transducer or a capacitive sensor. In the case of the embodiment in FIG. 6, the amount of water in the storage region 19 can be measured in a similar way. The required flows—i.e. the basic flow F1, the additional flow F2 and the cooling flow F—are generally not measured, even when this is of course possible in principle.

Both in the case of the embodiments in FIGS. 4 and 5 and in the embodiment in FIG. 6, it is possible for the setpoint flow F* to be specified directly and immediately to the control device 13. However, the thermodynamic energy state H of the rolled product 1 is preferably known to the control device 11 immediately before it reaches the application device 6. The thermodynamic energy state H can be, in particular, the enthalpy or temperature of a respective segment of the rolled product 1. In this case, the control device 13 first of all determines the setpoint flow F* as a function of the thermodynamic energy state H and then uses the setpoint flow F* to determine at least the associated setpoint actuation state S2* and possibly also the associated setpoint actuation state S1*. In particular, it is possible to stipulate to the control device 13 a local or time-based setpoint characteristic of the thermodynamic energy state H that should be maintained if possible. The control device 13 can therefore determine what thermodynamic energy state H should pertain immediately after the application device 6. By comparison with the actual thermodynamic energy state H immediately ahead of the application device 6, the control device 13 can therefore determine what quantity of coolant 7 must be applied to the corresponding segment of the rolled product 1 to ensure that the actual thermodynamic energy state H immediately after the application device 6 corresponds as well as possible to the desired setpoint state. The required quantity of coolant 7, in combination with the time that the corresponding segment of the rolled product 1 requires to run through the application device 6, then defines the setpoint flow F*.

The thermodynamic energy state H of the corresponding segment of the rolled product 1 varies from application device 6 to application device 6. In particular, it is modified by each of the application devices 6. The thermodynamic energy state H for the application device 6 which applies its share of coolant 7 first to the rolled product 1 can be stipulated as such to the control device 13. It is possible, for example, in accordance with the illustration in FIG. 1 to arrange on the inlet side of the cooling section 2 a temperature measurement location 23 by means of which the respective temperature or, more generally, the energy state H, for the individual segments of the rolled product 1 is detected. The detected energy state H is then associated with the respective segment.

Tracking is implemented for each segment during its passage through the cooling section 2. For each additional application device 6 which applies its share of coolant 7 later, it is necessary, however, to update the corresponding thermodynamic energy state H of the rolled product 1 (or of the corresponding segment of the rolled product 1). In this process, the control device 13 takes account, in particular, of the thermodynamic energy state H immediately ahead of the immediately preceding application device 6 and the quantity of coolant 7 which the immediately preceding application device 6 applies to the rolled product 1. As regards the quantity of coolant 7, the control device 13 can alternatively take account of the setpoint flow F* or of the cooling flow F of the immediately preceding application device 6. Thus, it determines the respective thermodynamic energy state H of the rolled product 1 sequentially in succession for the application devices 6. As far as is necessary, it is possible in this context for the control device 13 to set up and iteratively solve a heat conduction equation and a phase transition equation.

In many cases, the rolled product 1 is a flat rolled product, e.g. a strip or a plate. In this case, it is possible that the liquid coolant 7 is applied to the rolled product 1 from both sides by means of each individual application device 6. This procedure is often adopted in the case of a cooling section 2 which is arranged upstream of the rolling train or is arranged in the rolling train. However, it can also be adopted if the cooling section 2 is arranged downstream of the rolling train. Particularly when the cooling section 2 is arranged downstream of the rolling train, however, the liquid coolant 7 is generally applied to the rolled product 1 from only one side by means of each individual application device 6, in particular from above or from below. Of course, it is also possible in this case too to apply coolant 7 on both sides of the flat rolled product 1. In this case, however, this is performed by different application devices 6.

In extreme cases, it is possible for each of the application devices 6 to have just a single spray nozzle. In general, however, the application devices 6 each have a plurality of spray nozzles. The spray nozzles can be arranged in series when viewed in the transport direction x of the rolled product 1. The spray nozzles can be arranged in series within a single spray bar, for example. It is also possible for a plurality of spray bars arranged in series in the transport direction x to be combined into one (1) application device 6. This applies irrespective of whether the respective spray bar as such has or does not have a plurality of spray nozzles arranged in series.

As an alternative or in addition to an arrangement of spray nozzles in series, the application devices 6 can furthermore have a plurality of spray nozzles which are arranged side-by-side when viewed transversely to the transport direction x of the rolled product 1. Such an embodiment can be expedient particularly in the case of a flat rolled product 1, i.e. a strip or a plate. In this case, the application devices 6 can extend over the full width of the rolled product 1. Alternatively, it is possible for the application devices 6 to extend only over part of the width. In this case, therefore, a plurality of application devices 6 is arranged side-by-side and supplied with coolant 7 in each case via a dedicated supply line 8 and a dedicated control valve 10.

All the procedures explained above in conjunction with one of the application devices 6 and the associated components thereof can also be carried out for the other application devices 6 in a fully analogous way. As already explained, the procedure mentioned is furthermore carried out for each segment of the rolled product 1.

The present invention has many advantages. In particular, highly dynamic setting of the cooling flows F is possible. As the dead time of the application devices 6 there are in addition only the generally very short times that the coolant 7 requires to strike the rolled product 1—calculated from emergence from the respective application device 6. Switching off the cooling flow F is possible within a few tenths of a second (often under 0.2 s, sometimes even under 0.1 s). The same applies when ramping up the cooling flow F. The drives for the active devices 16 can be controlled very accurately. A normal accuracy for the speed n is in the region of 0.1%. The cooling flow F for the respective application device 6 can also be adjusted with the same or similar accuracy. Taking into account the response behavior of the drives 12, it should in all probability be possible to achieve correction of the cooling flow F with an accuracy of 1% in less than 0.5 s, possibly even in 0.2 s to 0.3 s. Wear on the turbines, pumps and drives is low. Typical service lives for pump bearings are 100,000 hours and above, for example. Similar values apply to the bearings of turbines. Furthermore, pressure shocks are avoided since, although the respective cooling flow F is reduced very quickly, the respective basic flow F1 is not. In the case of a laminar cooling section, therefore, low-cost control flaps can be used. Particularly when cooling roughed strips, it is furthermore even possible to selectively cool the "skid marks" in the roughed strip differently from the rest of the roughed strip. This is not possible in the prior art for lack of appropriate dynamic performance. However, even in the case of normal cooling sections, shorter delay times and thus more accurate temperature management of the rolled product 1 are obtained.

If a laminar cooling section is provided with application devices 6 according to the invention, a turbine with a power of in each case about 2 kW is typically required in the case of the "air version" (FIGS. 4 and 5). In the case of intensive cooling or of roughed strip cooling, the "water version" (FIG. 6) is preferably employed. The required power for the pump is typically about 25 kW.

Although the invention has been illustrated and described more specifically in detail by means of the preferred illustrative embodiment, the invention is not restricted by the examples disclosed, and other variants can be derived therefrom by a person skilled in the art without exceeding the scope of protection of the invention.

LIST OF REFERENCE SIGNS

1 rolled product
2 cooling section
3 to 5 rolling stands
6 application devices
7 coolant
8, 17 supply lines
9 reservoir
10 control valves
11 pump
12 buffer region
13 control device
14 computer program
15 machine code
16 active device
18 further medium
19 storage device
20 control line
21, 22 valves
23 temperature measurement location
F cooling flow
F1 basic flow
F2 additional flow
F* setpoint flow
p, p' pressures
S1*, S2* setpoint actuation states
S3*, S4* control signals
x transport direction

The invention claimed is:

1. An operating method for a cooling section is arranged within a rolling train for a hot rolled product or arranged upstream or downstream of the rolling train for cooling a hot rolled product made of metal;

the method comprising:

operating a control device of the cooling section for dynamically determining a respective setpoint actuation state for a respective control valve arranged in a respective supply line and for actuating the respective control valve accordingly;

feeding a respective basic flow of a liquid water-based coolant to a plurality of application devices of the cooling section via the respective supply line in accordance with the actuation of the respective control valve by the control device;

feeding the respective basic flow via the respective supply line to a respective buffer region of the respective application device, applying a respective cooling flow of the coolant from the respective buffer region to the hot rolled product by means of the respective application device;

additionally dynamically determining from the control device a respective further setpoint actuation state for a respective active device and actuating the respective active device accordingly, the respective active device feeding a respective additional flow of a further medium to the respective buffer region via a respective further supply line in accordance with the actuation of the respective active device by the control device;

the respective cooling flow depends both on the respective basic flow flowing through the respective control valve and on the respective additional flow flowing via the respective active device;

wherein the respective additional flow is positive or negative depending on the respective further actuation state of the respective active device; and setting the respective additional flow by the control device in such a way, by correspondingly actuating the respective active device, so that the respective cooling flow is approximated as closely as possible at all times to a respective setpoint flow of the coolant to be applied to the hot rolled product by means of the respective application device.

2. The operating method as claimed in claim 1, further comprising actively delivering the further medium by the respective active device.

3. The operating method as claimed in claim 2, wherein the further medium is air or water.

4. The operating method as claimed in claim 1, further comprising taking the further medium from a respective storage device.

5. The operating method as claimed in claim 4, further comprising placing the further medium in the respective storage device under a respective pressure.

6. The operating method as claimed in claim 5, further comprising setting the respective pressure in the respective storage device via a respective control line connected to the respective storage device.

7. The operating method as claimed in claim 6, further comprising correcting the respective pressure in the respective storage device in accordance with the setpoint flow or with a respective second pressure prevailing in the respective buffer region.

8. A cooling section arranged within a rolling train or arranged upstream or downstream of the rolling train;

the cooling section is operable to cool a hot rolled product made of metal;

the cooling section having:

a plurality of application devices, which are connected via a respective supply line to a source of a liquid, water-based coolant;

a respective control valve arranged in the respective supply line;

the application devices have a respective buffer region which is connected to the respective supply line, for causing the respective supply line to feed a respective basic flow of the coolant to the respective buffer region of the respective application device and;

starting from the respective buffer region, the cooling section being operable to apply a respective cooling flow of the coolant to the hot rolled product by means of the respective application device;

the cooling section has a control device which controls the respective control valve;

the respective buffer region having a respective active device, for feeding an additional flow of a further medium to the buffer region via a further supply line, wherein the respective cooling flow depends both on the basic flow flowing through the respective control valve and on the respective additional flow flowing via the respective active device; and the control device, configured to control the respective control valve and also the respective active device, and arranged within the rolling train for the hot rolled product or arranged upstream or downstream of the rolling train for cooling the hot rolled product made of metal, wherein the control device is configured to dynamically determine, for the plurality of application devices of the cooling section, a respective setpoint actuation state for the respective control valve arranged in the respective supply line and is configured to actuate the respective control valve accordingly, for feeding the respective basic flow of the liquid, water-based coolant to the respective buffer region of the respective application device via the respective supply line in accordance with the actuation of the respective control valve by the control device;

the control device being configured for additionally dynamically determining a respective further set-point actuation state for the respective active device and being configured for actuating the respective active device accordingly, for causing the respective active device to feed the respective additional flow of the further medium to the respective buffer region via the respective further supply line in accordance with the actuation of the respective active device by the control device; and the control device being configured to set the respective additional flow to positive and negative values in such a way that the respective cooling flow is approximated as closely as possible at all times to a respective setpoint flow to be applied to the hot rolled product by means of the respective application device.

9. The cooling section as claimed in claim 8, wherein the respective active device is configured to actively deliver the further medium.

10. The cooling section as claimed in claim 9, wherein the further medium is air or water.

11. The cooling section as claimed in claim 8, wherein the further medium is taken from a respective storage device.

12. The cooling section as claimed in claim 11, wherein the further medium is under a respective pressure in the respective storage device.

13. The cooling section as claimed in claim 8, wherein the the further comprising the further medium is taken from a respective storage device, such that the further medium in the respective storage device is under a respective pressure, and in that the control device sets the respective pressure in the respective storage device via a respective control line connected to the respective storage device.

14. The cooling section as claimed in claim 8, wherein the control device is configured to correct the pressure in the respective storage device in accordance with the setpoint flow or with a second pressure prevailing in the respective buffer region.

15. The cooling section as claimed in claim 8, wherein the control device is configured as a software-programmable device which is programmed with a computer program comprising machine code that can be executed by the control device, such that the execution of the machine code by the control device effects the corresponding determination of the respective setpoint actuation state for the respective control valve and of the respective further setpoint actuation state for the respective active device and the corresponding actuation of the respective control valve and of the respective active device.

* * * * *